United States Patent [19]

Dutt

[11] Patent Number: 4,986,430

[45] Date of Patent: Jan. 22, 1991

[54] TAMPER EVIDENT CLOSURE WITH TEAR OUT TAB INTEGRALLY MOLDED WITHOUT SLIDES

[75] Inventor: Herbert V. Dutt, Sarasota, Fla.

[73] Assignee: Continental Plastics, Inc., Triadelphia, Va.

[21] Appl. No.: 498,326

[22] Filed: May 29, 1990

[51] Int. Cl.[5] ..... B65D 41/32

[52] U.S. Cl. ..... 215/253; 215/252; 215/216

[58] Field of Search ..... 215/253, 252, 216, 221, 215/336

[56] References Cited

U.S. PATENT DOCUMENTS

| | | | |
|---|---|---|---|
| 2,092,547 | 9/1937 | Allenbaugh . | |
| 2,470,057 | 5/1949 | Spender | 215/252 X |
| 4,190,169 | 2/1980 | Pehr | 215/252 |
| 4,372,456 | 2/1983 | Guala . | |
| 4,393,978 | 7/1983 | Kessler et al. | 215/253 |
| 4,401,227 | 8/1983 | Pehr | 215/252 |
| 4,423,822 | 1/1984 | Powalowski | 215/253 X |
| 4,752,013 | 6/1988 | Miller et al. | 215/216 |
| 4,752,014 | 6/1988 | House et al. | 215/216 |

*Primary Examiner*—Stephen Marcus
*Assistant Examiner*—Vanena M. Roberts
*Attorney, Agent, or Firm*—Richard V. Westerhoff

[57] ABSTRACT

A tamper evident closure is integrally molded in a straight draw mold with a tear out tab extending laterally outward adjacent a slot in the free edge of the closure skirt and connected to the skirt by flexible, frangible bridges. After the closure is removed from the straight draw mold, the tear out tab is rotated about the flexible, frangible bridges into the slot and is retained therein by bevelled engagement ribs along the side edges of the tear out tab which snap over and engage the side edges of the slot. A radially inwardly directed projection on the tear out tab engages the conventional transfer bead on a container, and remains engaged thereby as the closure is unthreaded, thus, producing an axial force which fractures the bridges. The tear out tab then slides free of engagement with the edges of the slot and separates leaving a visual indication of prior removal of or tampering with the closure. If an attempt is made to reinsert the tear out tab in the slot, the torn ends of the fractured bridges extend laterally outward to provide an indication of the tampering.

10 Claims, 2 Drawing Sheets

TAMPER EVIDENT CLOSURE WITH TEAR OUT TAB INTEGRALLY MOLDED WITHOUT SLIDES

BACKGROUND OF THE INVENTION

1. Field of the Invention

This invention relates to closures for containers which provide a visual indication of attempts to open or otherwise tamper with the closure and more particularly to such a closure with a tear out tab which can be molded integrally with the closure in a straight draw mold without the need for slides or cams and which does not require modification to threaded containers with the typical transfer bead.

2. Background Information

There is a great deal of demand today for container closures which provide a visual indication that a container has been previously opened or tampered with in order to assure a user of the integrity of the contents of the container. Numerous designs have been proposed for such closures, many of which are difficult, and therefore expensive, to mold. In addition, some such closures require assembly of separate parts and some require a customized finish on the container.

It is common for containers to have a flange projecting radially from a threaded neck. This flange is engaged by equipment which transports the container during processing and therefore is referred to as a transfer bead. Many tamper evident closures include an annular tamper band attached to a closure skirt by frangible bridges circumferentially spaced around the tamper band and have a radially inwardly directed flange which engages the transfer bead on the container as the closure is threaded onto the container. When the closure is unscrewed, the inwardly directed flange remains engaged by the transfer bead. Axial displacement of the closure produced by rotation of the helical threads generates a force which fractures the bridges to separate the tamper band from the closure skirt, thereby providing a visual indication that the container has been opened or tampered with. Typically, such closures require slides or cams in the molds that produce them to form the bridges and the radially inwardly directed flange. This adds to the cost of making such closures and slows down production.

U.S. Pat. No. 4,372,456 discloses a container closure having such a tamper band connected to the closure skirt by a number of frangible bridges. A trapezoidal tab connected to the tamper band by additional frangible bridges extends into an axially extending slot in the bottom of the closure skirt, but is not connected to the closure skirt. When the cap is unscrewed, it separates axially from the tamper band which is engaged by the transfer bead on the container. While the tab is not directly connected to the closure skirt, the trapezoidal shape of the tab and slot create an interference fit as the closure is unscrewed which results in fracturing of the bridges and separation of the tab from the tamper band. The void left by removal of the tab provides a visual indication of tampering or prior removal of the closure. Such a closure; however, requires a mold with slides in order to form the bridges, tab and slot.

It is an object of the present invention to provide a container closure which has a removable tab for providing a visual indication of tampering, but which can be molded with a straight draw mold without the need for slides.

It is also an object of the invention to provide such a closure which can be used on containers with a conventional transfer bead without need for modification to the container.

SUMMARY OF THE INVENTION

These and other objects are realized by the invention which is directed to a tamper evident closure having a tear out tab integrally molded with the closure skirt. The closure has a slot extending axially from the free end of the skirt. The closure is molded with the tab extending laterally outward adjacent the slot and connected to the skirt by connecting means in the form of a plurality of flexible frangible bridges. The tab is rotatable about the bridges into the slot in the skirt and is retained in the slot by engagement means in the form of engagement ribs which extend circumferentially outward from the side edges of the tab and which are bevelled to slide over and form an interference fit with the side edges of the slot. A radially inwardly directed projection on the tab is bevelled axially and radially inward to slide over and engage the conventional container transfer bead as the closure is applied to the container. As the closure is unthreaded, the projection on the tab remains engaged with the transfer bead on the container to apply an axial force which fractures the flexible, frangible bridges and separates the tear out tab from the closure. The tab slides out of engagement in the slot as the closure is further unthreaded from the container and falls away. The empty slot in the closure skirt provides a visual indication of tampering or prior opening of the closure. If an attempt is made to reinsert the tear out tab in the slot when the closure is reapplied to the container, the ragged, torn ends of the frangible bridges project outward to provide the visual indication of tampering.

The invention includes the novel closure, and the novel closure in combination with a container.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
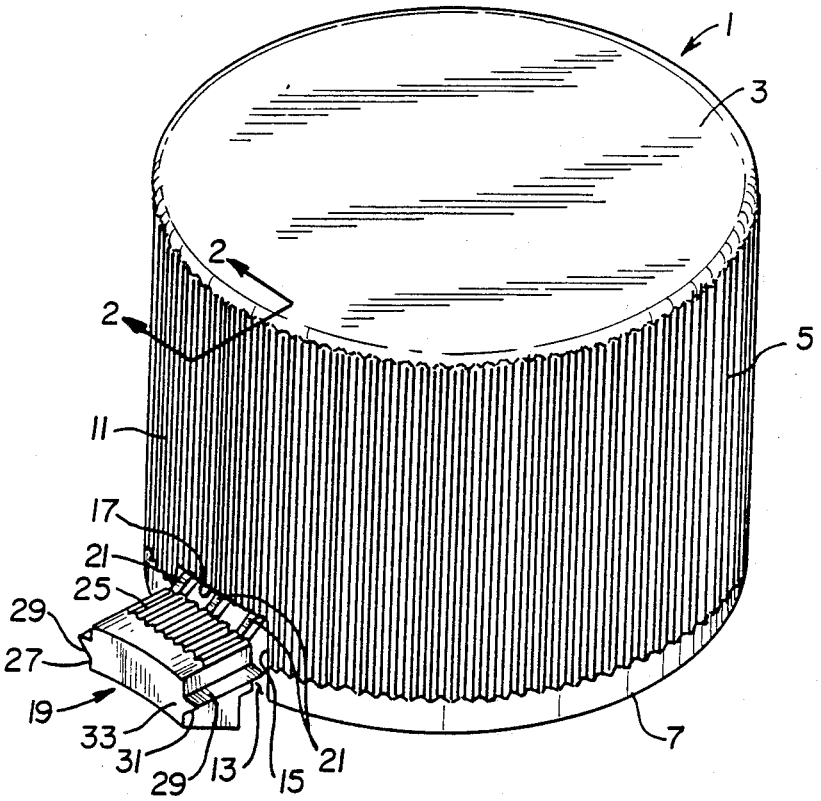
FIG. 1 is an isometric view of a closure in accordance with the invention in the configuration in which it is molded.
Figure 2:
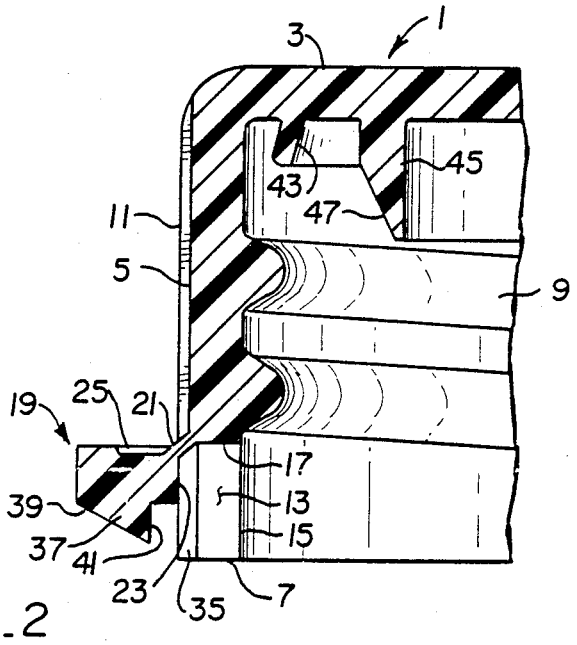
FIG. 2 is a vertical, fragmentary sectional view through a portion of the closure as shown in FIG. 1 taken along the line 2—2.

Referring to FIGS. 1 and 2, the closure 1 in accordance with the invention includes an end wall 3, and an annular skirt 5 axially extending from the end wall 3 and terminating in a free end 7. The skirt 5 is provided with an internal helical thread 9 and axially extending serrations 11 on the outer surface for making it easier to grip.

The skirt 5 has a slot 13 extending axially from the free edge 7. This slot 13 has side edges 15 and an end edge 17. The closure 1 is molded with a tear out tab 19 extending laterally outward adjacent the slot 13 as shown in FIGS. 1 and 2. The tear out tab 19 is connected to the skirt 5 by connection means in the form of a plurality, in the exemplary enclosure 3, integral, frangible bridges 21 which extend axially and radially outward from the end edge 17 of the slot 13 to the upper edge 23 of the tear out tab 19. The outer surface of the tear out tab 19 is provided with serrations 25 which are aligned with the serrations 11 in the skirt.

Extending circumferentially from side edges 27 of the tear out tab 19 are engagement ribs 29. These engagement ribs 29 have downwardly facing bevelled surfaces 31 and upper planar locking surfaces 33. These engagement ribs form cooperative locking means with the side edges 15 of the slot 13 in a manner to be discussed. The side edges 15 of the slot 13 are rabbeted to form flanges 35.

The tear out tab 19 also includes a projection 37 projecting axially as shown in the molded position of FIGS. 1 and 2. The projection 37 has a bevelled surface 39 and a flat locking surface 41.

The closure 1 also includes on the inner surface of the end wall 3 a pair of annular sealing ribs 43 and 45 as known in the art. The outer seal rib angles radially outward and the inner seal ring 39 has an outwardly facing bevelled surface 47 which, as will be seen, aid the seal ribs 43 and 45 in forming a seal with a container rim.

As can be appreciated from FIGS. 1 and 2 by those skilled in the art, the closure 1, with all of the details discussed above, can be molded in a straight draw mold with a horizontal parting line without the need for slides or cams. As is known in the art, the closure is unthreaded from the mold to release threads 9 and the thin sealing rib 43 flexes during extraction. None of the remaining features create any undercuts in the mold.

Figure 3:
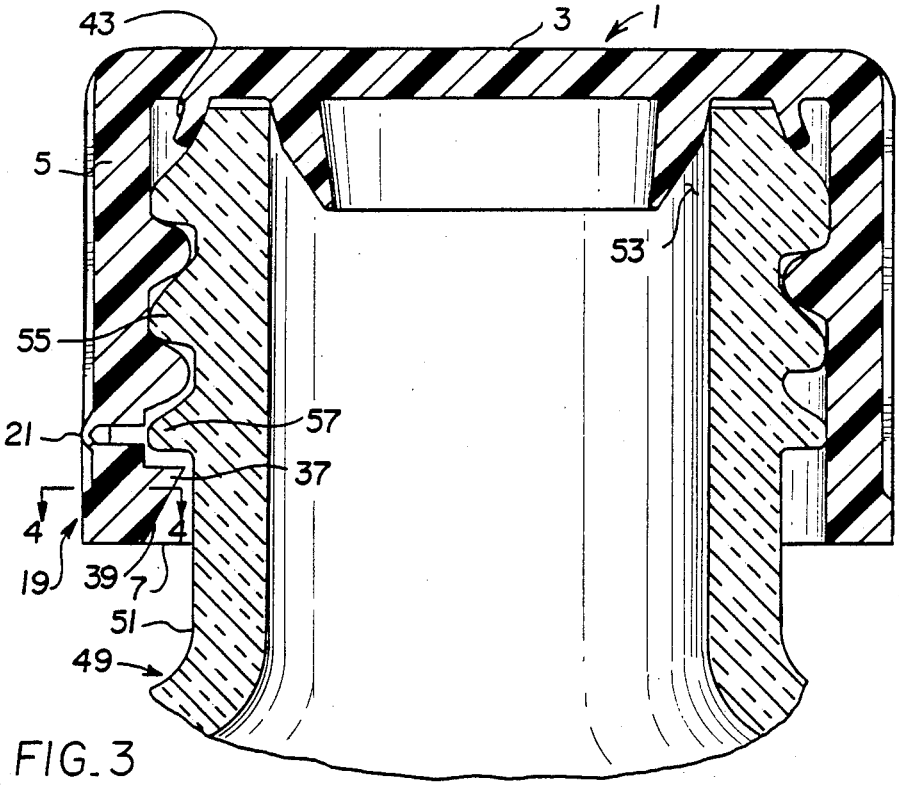
FIG. 3 is a vertical sectional view similar to that of FIG. 2 taken through the closure and a container on which the closure has been applied.
Figure 4:
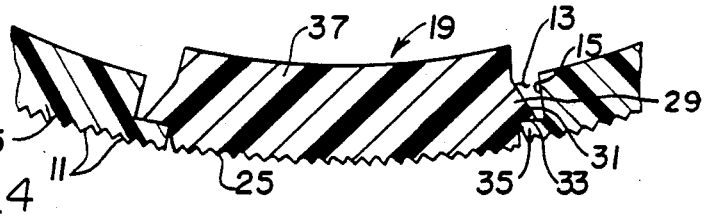
FIG. 4 is a horizontal, fragmentary sectional view through the closure taken along the line 4—4 in FIG. 3.

Once the closure 1 is removed from its mold, the tear out tab 19 is pivoted about the flexible, frangible bridges 21 and pressed into the slot 13 so that the bevelled engagement ribs 29 are snapped into place behind the flanges 35 on the side edges 15 of the slot as shown in FIGS. 3 and 4. The closure 1 can then be threaded onto a container 49 having a neck 51 defining a container opening 53 and provided with external threads 55 and a transfer bead 57 extending radially outward below the threads 55. As the closure 1 is threaded onto the container 49, the bevelled surface 39 on the projection 37 which is now projecting radially inward from the tear out tab 19, distorts the closure skirt until the projection 37 passes below the transfer bead 57. Alternatively, the closure could be threaded on to the container 49 and then the tear out tab 19 could be snapped into place as shown in FIG. 3. With the closure in place on the container, the flexible frangible bridges 21 are bent into loops as shown in the left side of FIG. 3.

Figure 5:
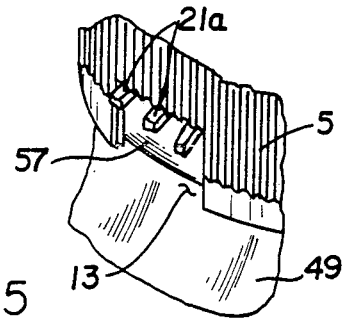
FIG. 5 is a fragmentary isometric view of the closure applied to a container after the closure has been removed and reapplied to the container.
Figure 6:
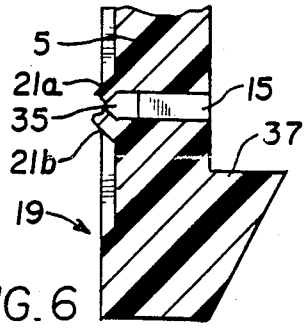
FIG. 6 is a fragmentary sectional view similar to FIG. 2 showing a closure which has been tampered with or reapplied after removal.

When the closure is unthreaded from the container neck, the pitch of the helical threads 9 and 55 lifts the closure 1 relative to the container 49, bringing the surface 41 of the projection 37 into contact with the transfer bead 57. Continued unthreading of the closure 1 causes axial extension and ultimately fracturing of the bridges 21. As the closure is unthreaded further, the ribs 29 on the tear out tab 19 slide out of the bottom of the slot 13 and the tear out tab 19 falls away. When the closure is reapplied to the container 49, the absence of the tear out tab 19 from the slot 13 provides an obvious visual indication that the closure has been removed as shown in FIG. 5. If an attempt is made to pry the tear out tab 19 from the slot 13, the force required to disengage the ribs 29 from the flanges 35 on the skirt will also result in tearing of the bridges 21. Since the bridges 21 are molded in the configuration shown in FIG. 2 and are bent into the position shown in FIG. 3, fracturing of these ribs will result in exposure of ragged ends of the two pieces **21*a* and 21*b* of each bridge which will extend outward. This indication of tampering will also be evident if an attempt is made to slide the tear out tab 19 back into the slot 13 after the cap has been removed as illustrated in FIG. 6**.

Additional tear out tabs 19 can be circumferentially spaced around the skirts of closure 1 if desired; however, one is adequate.

The closure in accordance with the invention provides a clear visual indication that the closure has been removed from the container or tampered with, and can be easily and economically fabricated in a straight draw mold without the need for slides or cams. The closure can be used without any modification required to containers with the conventional transfer bead.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A closure for a container having a neck terminating in a container opening, an external thread on said neck, and a transfer bead spaced from said container opening by said external thread, said closure comprising: an end wall, an annular skirt extending axially from said end wall and terminating in a free end, an internal thread on said annular skirt engaging the external thread on the container neck to secure said closure to the container and close said container opening, and a tampering indicator comprising a slot extending generally axially from said free end of said annular skirt, a tear out tab molded to extend laterally outward from said skirt and integrally joined thereto by flexible frangible connection means, said tear out tab being rotatable about said flexible frangible connection means into said slot, cooperative engagement means on said tear out tab and said annular skirt maintaining said tear out tab rotated into said slot, and a projection extending radially inward from said tear out tab to engage the transfer bead on said container neck when the closure is fully threaded onto the container neck and which remains engaged by said transfer bead as said closure is unthreaded to generate a force which fractures said frangible connection means to separate said tear out tab from the annular skirt, thereby providing a visual indication that an attempt has been made to remove the closure from the container.

2. The closure of claim 1 wherein said slot has a generally circumferentially extending edge portion and said flexible, frangible connection means extend from said skirt adjacent said generally circumferentially extending edge portion of the slot.

3. The closure of claim 2 wherein said flexible frangible connection means comprise a plurality of flexible frangible bridges spaced along said generally circumferentially extending edge portion of said slot.

4. The closure of claim 3 wherein said frangible bridges extend laterally as well as axially between the generally circumferentially extending edge portion of said slot and said tear out tab such that the bridges when fractured project outward to expose laterally projecting torn surfaces.

5. The closure of claim 2 wherein said slot has generally axially extending slot side edge portions as well as said generally circumferentially extending edge portion and said tear out tab has a generally circumferentially extending hinged edge portion from which said frangible connection means extends to join said tear out tab to said annular skirt and has tear out tab side edge portions, and wherein said cooperative engaging means include bevelled engagement ribs projecting generally circumferentially from said side edge portions of one of said slot and tear out tab which slide over and engage the side edge portions of the other of said slot and tear out tab.

6. The closure of claim 5 wherein said bevelled engagement ribs project generally circumferentially from said tear out tab side edge portions.

7. The closure of claim 6 wherein the side edge portions of said slot are rabbeted to receive said engagement ribs on said tear out tab.

8. In combination:

a container with a neck terminating in a container opening, an external thread on said neck and a transfer bead spaced from said container opening by said external thread; and a closure comprising an end wall, an annular skirt extending axially from the end wall and terminating in a free end, and tamper indicating means including a slot extending axially from said free end of said annular skirt, a tear out tab integrally molded with said annular skirt extending generally laterally outwardly therefrom and joined thereto by flexible, frangible connection means about which said tear out tab is rotatable into said slot, engagement means maintaining said tear out tab rotated into said slot, and a projection extending radially inward from said tear out tab when rotated into said slot and engaging the transfer beard on said container with the closure threaded onto said container, said projection remaining engaged with said transfer bead when said closure is unthreaded from the container to generate a force which fractures said flexible frangible connecting means to separate the tear out tab from the annular skirt.

9. The combination of claim 8 wherein said slot has a generally circumferentially extending end wall between a pair of side walls, said tear out tab has generally circumferentially extending top and bottom edges and a pair of side edges, said flexible frangible connection means joining the top edge of said tear out tab to the end edge of said slot, and said cooperative engagement means extending along the side edges of said slot and said tear out tab.

10. The combination of claim 9 wherein said flexible, frangible connection means comprise a plurality of bridges spaced along the top edge of said tear out tab and wherein said cooperative engagement means comprise bevelled engagement ribs projecting generally circumferentially from the side edges of said slot or tear out tab and sliding over and engaging the side edges of the other.

* * * * *